US006116058A

United States Patent [19]

Diestel et al.

[11] Patent Number: 6,116,058

[45] Date of Patent: Sep. 12, 2000

[54] PROCESS AND INSTALLATION FOR PRODUCING TEXTILE NET-LIKE FABRICS

[75] Inventors: Olaf Diestel; Gerd Franzke; Peter Offermann; Wolfram Schinkoreit, all of Dresden, Germany

[73] Assignee: Textilma AG, Hergiswil, Switzerland

[21] Appl. No.: 09/302,894

[22] Filed: Apr. 30, 1999

Related U.S. Application Data

[63] Continuation-in-part of application No. 08/491,920, Mar. 18, 1996, abandoned.

[30] Foreign Application Priority Data

Apr. 16, 1997 [WO] WIPO ..... PCT/EP97/01890

[51] Int. Cl.[7] ..... D04B 23/22

[52] U.S. Cl. ..... 66/84 A; 66/83

[58] Field of Search ..... 66/83, 84 R, 84 A, 66/85 R, 85 A

[56] References Cited

U.S. PATENT DOCUMENTS

| | | | |
|---|---|---|---|
| 1,924,649 | 8/1933 | Morton | 66/85 R |
| 3,552,151 | 1/1971 | Schuler et al. | 66/84 A |
| 3,677,206 | 7/1972 | Maclssac, Jr. et al. | 66/85 A |
| 4,433,493 | 2/1984 | Poisson | 34/116 |
| 4,638,647 | 1/1987 | Grenzendoerfer et al. | 66/84 A |

*Primary Examiner*—Danny Worrell
*Attorney, Agent, or Firm*—Friedrich Kueffner

[57] ABSTRACT

The invention is directed to a process and a device for the production of textile net-like fabrics by various bonding processes, e.g., the warp knitting process or stitch bonding process. Based on the object of the invention—to provide a process and a device for carrying out the process for producing textile net-like fabrics with threads which are continuous in the working direction and transversely thereto and which form mesh sides of the net, with large mesh widths, a high variability of structure, and product widths extending beyond the working width —a plurality of adjacent groups (4) of mesh side threads forming the mesh sides in the working direction are produced, a function thread (12) is guided from one longitudinal side of the fabric to be produced to the opposite longitudinal side of the fabric to be produced in order to form the other mesh side lying transversely to the working direction, the function thread is temporarily set in its position transversely to the working direction at least at two setting points arranged adjacent to one another transversely to the working direction, the function thread is formed into at least one loop in order to form function thread reserves (13) between two setting points arranged transversely to the working direction, the function thread which is provided with at least one function thread reserve and is temporarily set transversely to the working direction is tied on or tied in at the same time at least at two adjacent groups of mesh side threads, and the temporary setting of the function thread is canceled.

5 Claims, 6 Drawing Sheets

PROCESS AND INSTALLATION FOR PRODUCING TEXTILE NET-LIKE FABRICS

This application is a CIP of Ser. No. 08/491,920 filed Mar. 18, 1996 now abandoned.

BACKGROUND OF THE INVENTION

1. Field of the Invention

The invention is directed to a process and a device for the production of textile net-like fabrics by various bonding processes, e.g., the warp knitting process or stitch bonding process.

2. Description of the Related Art

In the textile industry, nets are commonly manufactured with known net-tying machines or net-knotting machines by means of knotting hooks or with known warp knitting machines or stitch bonding machines by means of latch needles or slide needles. In so doing, it is disadvantageous that the product width is determined by the working width and by the stitch structure and that the variability of structure is sharply restricted by the processes or can only be realized at a high cost.

The production of warp-knitted nets with continuous yarns in the working direction and transversely thereto is unusual. A modified warp knitting machine is known (DE 2706930) for working plastic yarns with parallel weft insertion in which the yarns are bonded by means of fusing swords. The product width which can be produced in this way only corresponds to the working width of the machine. The net stitch geometry is determined by the fixed working width and the arrangement of the bonding elements, i.e., the fusing swords. Further, only thermoplastic materials can be processed by the selected bonding method so that the range of possible applications of the product is limited.

Stitch bonding machines on which square-stitch nets can be manufactured with continuous weft yarns in the working direction and transversely thereto are also known (DD 269298). For this purpose, parallel weft yarns are entered transversely to the working direction and are passed through in the work location at determined intervals transversely to the working direction by working members forming wale portions and are tied on or tied in by means of stitching yarns looping around the warp yarns.

It is disadvantageous that the magnitude of the stitch apertures determined by the distance between the inserted weft yarns and the relative distance between the working members forming the wales cannot be changed. Further, the maximum product width is equal to the working width and the products have low strength due to the fact that the weft yarn pattern is also tacked by bearded needles not participating in the stitch formation.

The object of the present invention is to provide a process and a device for carrying out the process by various bonding processes, principally the warp knitting process or stitch

SUMMARY OF THE INVENTION bonding process, for producing textile net-like fabrics with yarns which are continuous in the working direction and transversely thereto and which form stitch sides of the net, with large stitch widths, a high variability of structure, and product widths extending beyond the working width.

In accordance with the present invention, the process for producing textile net-like fabrics from yarns includes forming a plurality of groups of stitch side yarns located next to each other in travel direction of the fabric to be produced, wherein the groups of stitch side yarns are connected exclusively by function yarns extending from one longitudinal side of the fabric to be produced to the other longitudinal side thereof. Each function yarn is temporarily set in its position transversely of the travel direction at least at two setting points arranged adjacent to one another transversely of the travel direction, wherein the function yarn is formed into a loop in order to form a function yarn reserve between the setting points. Simultaneously, the function yarn which is temporarily set transversely of the travel direction and is provided with the function yarn reserve is fastened to at least two groups of stitch side yarns located next to one another and the temporary setting of the function yarn is cancelled.

The invention is described more fully in the following with reference to an embodiment example.

DESCRIPTION OF THE PREFERRED EMBODIMENTS

Figure 1:
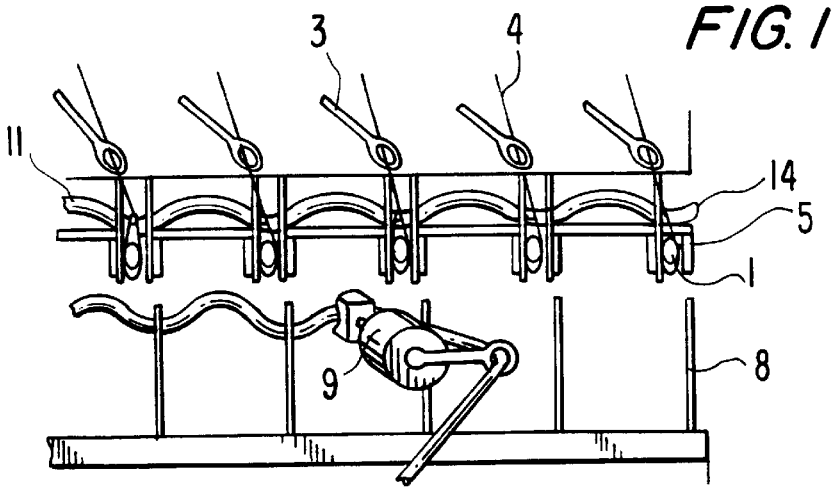
FIG. 1 shows a schematic view of the following process steps: laying of the yarn, including formation of function yarn reserves.

FIGS. 1–4 show a schematic view of the process steps according to the invention. The schematic view in FIG. 1 shows that the function yarn 11 is already tied in the adjacent groups of stitch side yarns 14 forming the stitch sides of the net in the working direction. The groups of stitch side yarns are formed from warp threads 4. The next function thread is guided from one longitudinal side of the fabric to be produced to the opposite longitudinal side to form the other stitch side lying transversely to the working direction. For this purpose, the function yarn is temporarily set at a plurality of locations and is formed in a loop between the setting points in order to form a function yarn reserve.

Figure 2:
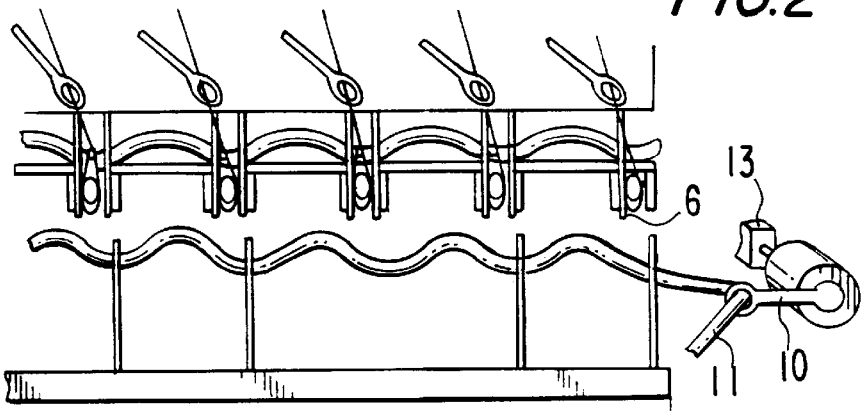
FIG. 2 shows a schematic view of the following process step: paused position.

FIG. 2 shows the pause position in which the process described above is concluded.

Figure 3:
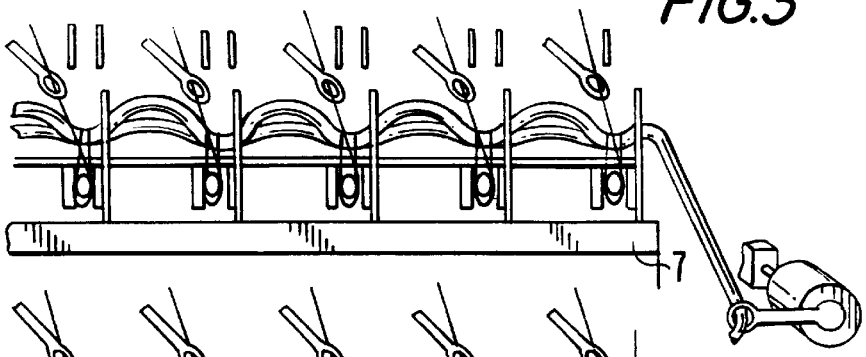
FIG. 3 shows a schematic view of the process step for tying in or tying on the function yarn at the groups of stitch side yarns.

The schematic view shown in FIG. 3 shows that the looped function yarn 11 is guided to the groups of stitch side yarns and is tied on or tied in by means of the warp yarns at the same time. The temporary setting is canceled after tying in or tying on. According to a first variant, it is possible in this process step to feed the function yarn along the entire width and tie it in or tie it on in one work cycle. According to a second variant, the feeding of the function yarn and the tying in or tying on is accomplished over a plurality of work cycles so that a stepped, temporary working edge is formed during the working process.

By function yarn reserve is meant a loop-shaped yarn reserve which is formed in the system of function yarns during the fabrication of a textile net in the process of stitch formation and which can be canceled by transferring the textile product from its production position to the use position (spreading).

Figure 4:
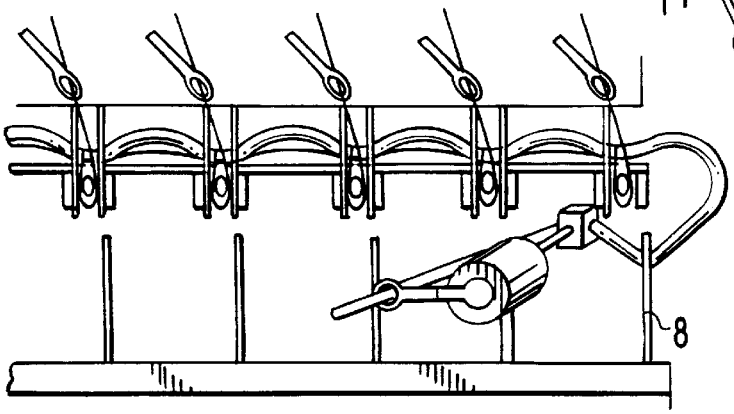
FIG. 4 shows a schematic view of the process step in which the laying of the function yarn is begun.

FIG. 4 shows how the function yarn is guided to the starting longitudinal side corresponding to the process step shown in FIG. 1 for forming the next stitch side.

In the process according to the invention it is possible to lay one or more function yarns, to loop them, and then to tie on or tie in the function yarn or function yarns at the same time in one or more work cycles. Further, it is possible for the function yarn to be deflected between the setting points not at all and/or by identical amounts and/or by different amounts, wherein the next function thread in the working direction can also be deflected not at all and/or by the same amount and/or by different amounts relative to the preceding function yarn.

As is shown in FIGS. 1 to 4, the groups of stitch side yarns are formed and the tying in or tying on is effected by the warp knitting process using at least one warp yarn. It is also possible to form the groups of stitch side yarns by the warp knitting process using a warp yarn and a stationary weft yarn. The formation of the groups of stitch side yarns and the tying in and tying on can also be effected by the known stitch bonding process using at least one stitching yarn or at least one stitching yarn and at least one stationary weft yarn. Further, it is possible to form the groups of stitch side threads and to tie in or tie on by the known crochet galloon process using at least one warp yarn or at least one warp yarn and at least one stationary weft yarn. Finally, the group of stitch side yarns and the tying in or tying on can be carried out by the known net-knotting process using at least one warp yarn. Tying in and tying on can also be effected by thermal or chemical means. In the process according to the invention, it is possible to use an endless function yarn, as shown in FIGS. 1 to 4, or a finite function yarn which is severed from the function yarn supply coil 12 at each longitudinal side. For this purpose, it is necessary to set the loose end at the longitudinal side temporarily.

Figure 5B:
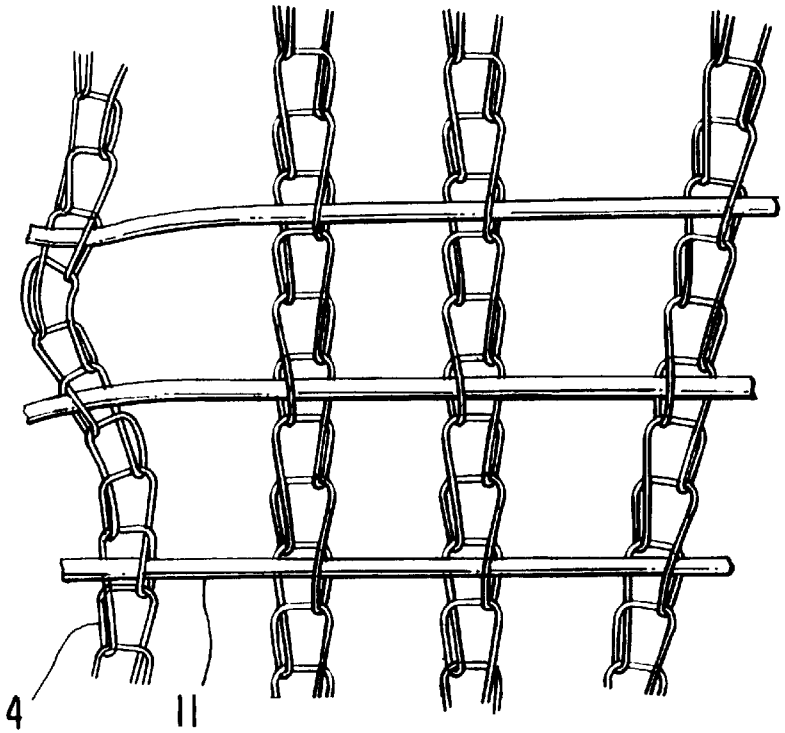
FIGS. 5*a–h* show product examples in the production position and in the use position.
Figure 5A:
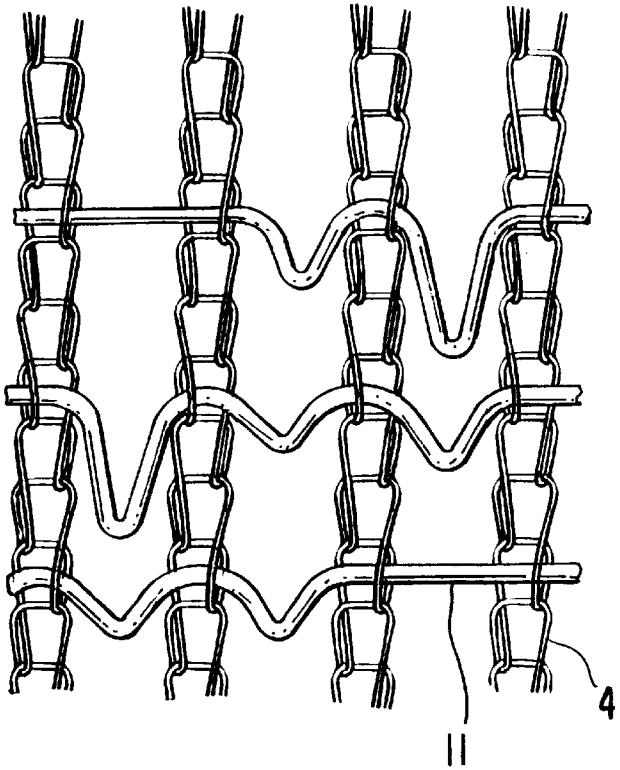
Figure 5D:
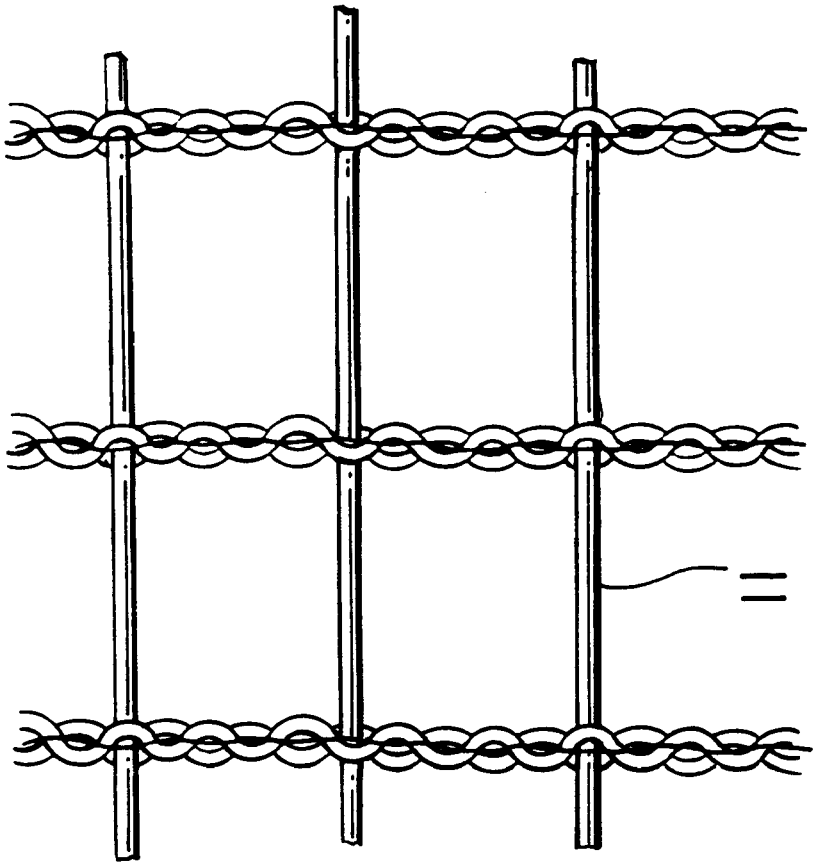
Figure 5C:
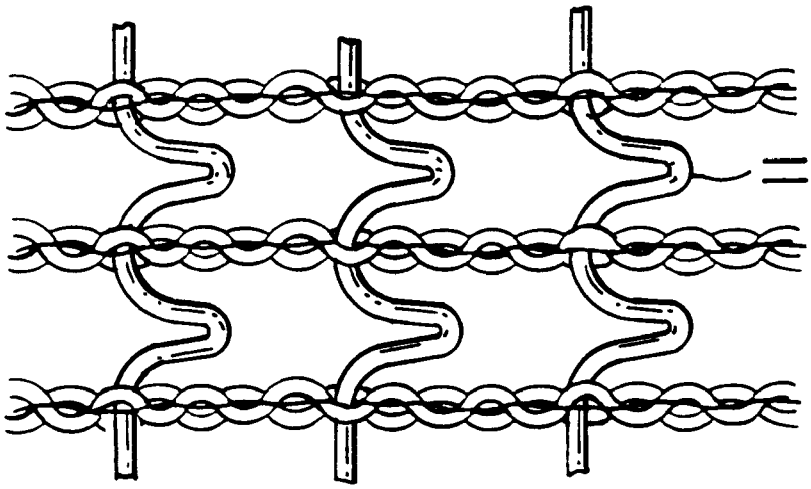
Figure 5F:
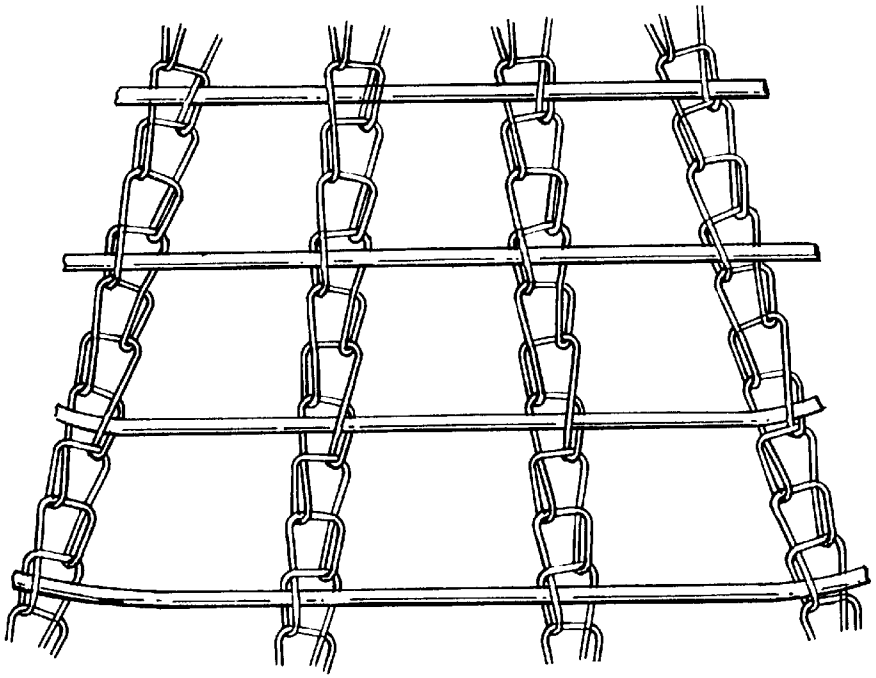
Figure 5E:
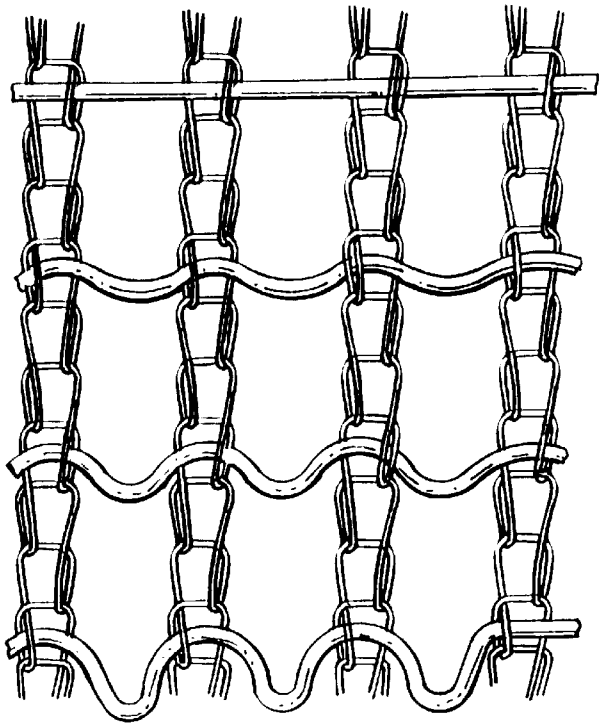
Figure 5H:
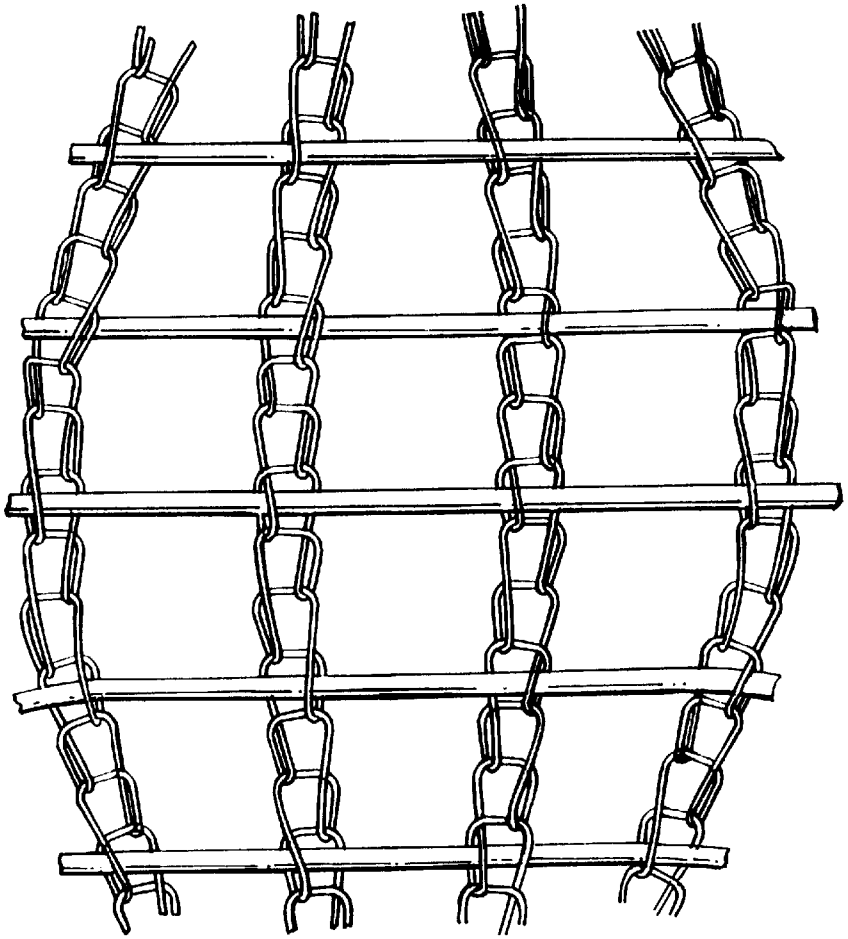
Figure 5G:
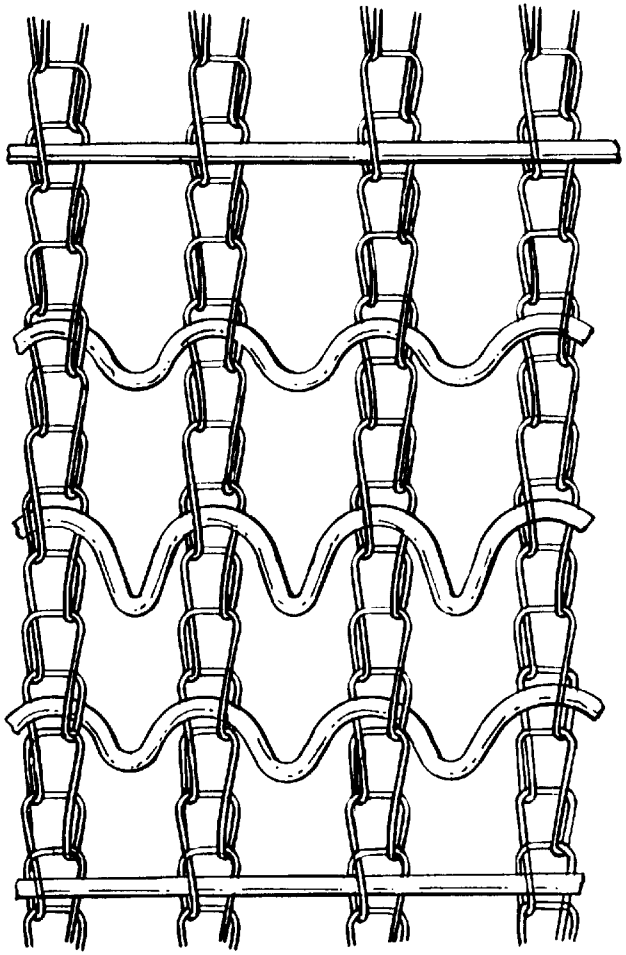

FIGS. 5*a–h* show product examples in the production position and in the use position. FIG. 5*a* shows a product example in which the last function yarn at right angles to the working direction is first not deflected at all, then is deflected by a small amount and, finally, by a larger amount than the preceding amount. The following function yarns are deflected transversely to the working direction and by different amounts relative to the function yarn preceding them in the working direction, wherein this amount can also be zero. It will be seen that every conceivable net structure can be achieved by different deflections transversely to and in the working direction. It will also be seen that a net width exceeding the working width can be achieved.

Figure 6:
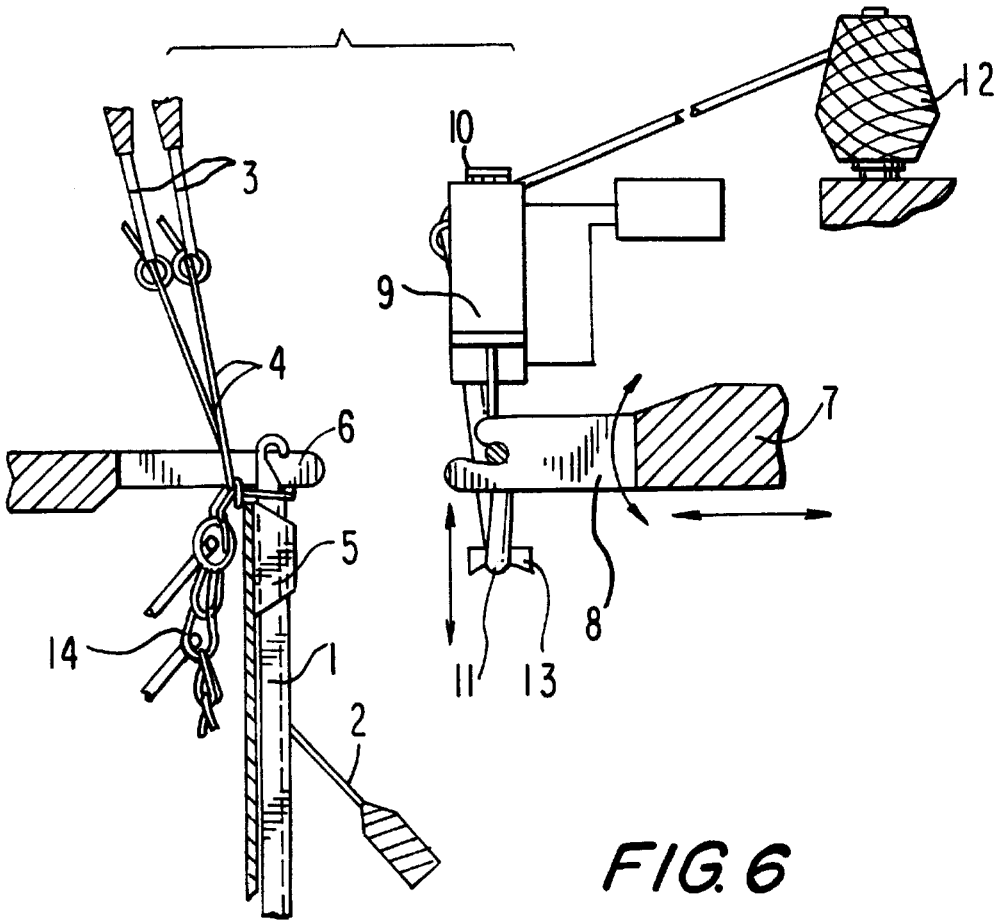
FIG. 6 shows a side view of a warp knitting work location.

FIG. 6 shows a side view of a device for carrying out the described process in which the group of stitch side yarns is joined with the function yarn by means of a warp knitting work location. The warp knitting work location has a plurality of slide needles 1 which are assembled on a needle bar and can be moved jointly, a closing wire 2 being associated with each slide needle 1, one or more yarn guides which are constructed as guide bars and have thread guide elements for the warp yarns 4 which are mostly constructed as eye needles 3, a comb plate 5 which is arranged between the slide needles 1, and the trace comb 6. According to the invention, a system for laying in function yarns which acts via at least two slide needles 1 lying adjacent to one another transversely to the working direction is associated with the warp knitting work location. In the construction shown in the drawing, this system for laying in the function thread has a plurality of elements for receiving the function yarn and for setting the function yarn reserve, these elements being constructed as sinkers 8 which are fastened in a row in a stationary manner on a bar 7 which extends transversely to the working direction along the entire working width of the machine and which is rotatable about its longitudinal axis and movable horizontally at right angles to its longitudinal axis. The system for laying in the function yarn also comprises a system 9 for forming the function yarn reserve. This system 9 moves back and forth transversely to the working direction along the entire width of the bar 7 in a translatory movement with pauses. During this movement, the function thread 11 is drawn off from the function yarn supply coil 12 arranged centrally with respect to the work location and is laid in the sinkers 8. A function yarn guide 10 which is arranged so as to be rotatable is associated with the system 9 for forming the function yarn reserve and is rotated in the movement direction of the system 9 for forming the function yarn reserve. While the function yarn 11 is being drawn off from the function yarn supply coil 12 and laid in the sinkers 8, the function yarn reserve is formed during the pause in movement by lowering the element 13 forming the function yarn reserve. In the system for forming the function yarn reserve, a drive constructed as a gear unit is associated with the element 13 for forming the function yarn reserve and a patterning control unit is associated with the drive. The patterning control unit is correlated with the controls for the other elements and systems.

If the feeding of the function yarn and the tying in or tying on are not carried out simultaneously in one work cycle, but rather so as to be spread out among a plurality of work cycles, a plurality of systems 9 for forming the function yarn reserve are arranged at an angle relative to the transverse working direction. Accordingly, this device enables a semi-continuous operation.

The invention can also be used at warp knitting work locations or stitch bonding work locations with two needle systems or with knitting needles constructed as latch needles or bearded spring needles.

Figure 7:
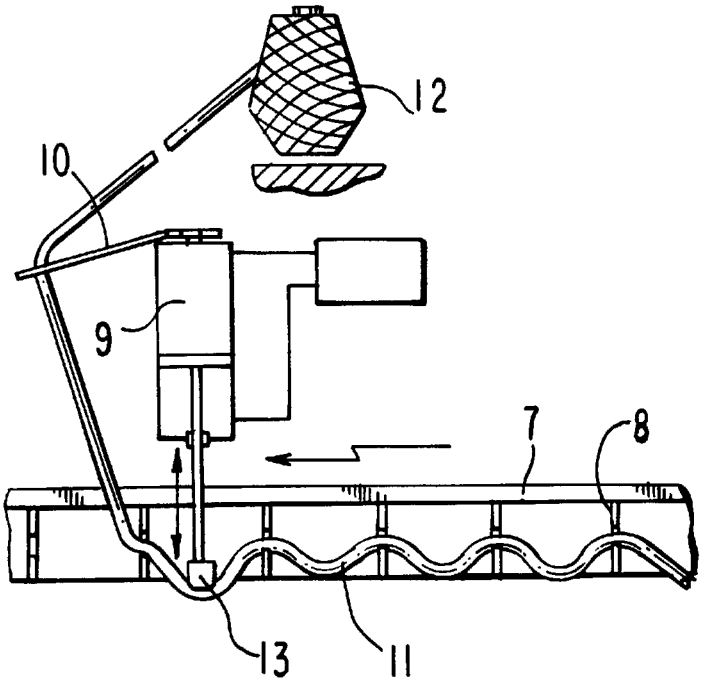
FIG. 7 shows a front view of a warp knitting work location.

FIG. 7 shows a front view of the system for laying in the function yarn with the system 9 for forming the function yarn reserve during the formation of the yarn reserve between two sinkers 8.

A detailed description of the other known processes (stitch bonding, crochet galloon process, net knotting) for producing a group of mesh side yarns and for tying on or tying in the function yarn 11 which is worked according to the invention is omitted since the process of forming the group of mesh side yarns and tying on or tying in is known in general.

The operation of the devices according to the invention is described in the following with reference to FIGS. 1 to 4. FIGS. 1 to 4 show a schematic top view of the work location. FIG. 1 shows the system 9 for forming the function yarn reserve while the function yarn 11 is being laid in the sinkers 8 of the system for laying in the function yarn by means of function yarn guides 10, the temporary setting of the function yarn 11 in the sinkers 8, and the formation of the function yarn reserve which takes place (FIG. 1 is a top view corresponding to FIG. 7). The slide needles 1 are located at the bottom dead center so that the needle heads are located below the upper edge of the comb plate 5.

In FIG. 2, the process of laying the function yarn 11 and the formation of the function yarn reserve which takes place in so doing is concluded. The system 9 for forming the function yarn reserve is outside the region of the work location in the hold position and the function yarn guide 10 is already swiveled by 180° into the next movement direction.

FIG. 3 shows the work location at the moment that the function yarn 11 is being laid in. For this purpose, the trace comb 6 moves back horizontally out of the work location and the bar 7 with the sinkers 8 which have temporarily set the function yarn 11 with the function yarn reserves moves horizontally into the work location. In so doing, the function yarn reserves are lifted over the upper edge of the comb plate 5 by an upward rotating movement of the bar 7 about its longitudinal axis and are brought to the rear of the comb plate 5 in that the bar 7 swivels back. During the subsequent spreading, the function yarn 11 with the function yarn reserve is located between the back of the slide needle and the warp yarn 4. During the spreading, the sinkers 8 take over the function of the trace comb 6. The bar 7 then moves horizontally out of the work location, the trace comb 6 moves in again horizontally, the warp yarns 4 are laid to form the fringe, and knock-over is effected. The function yarn 11 is accordingly tied on.

As is shown in FIG. 4, the system 9 for forming the function yarn reserve now moves back. In so doing, the function yarn 11 is again laid in the sinkers 8 of the bar 7 and, according to the invention, is deflected to form function yarn reserves in accordance with the pattern. At the same time, another piece of the stitch side of the net is produced in the working direction in the work location corresponding on the net geometry.

The closing wires 2, the function yarn supply coil 12 and the patterning control of the system 9 for forming the function yarn reserve are not shown in FIGS. 1 to 4 for the sake of clarity.

What is claimed is:

1. A device for producing textile net-like fabrics, the device comprising a feeding means for supplying at least one of a stitching yarn, a warp yarn and a stationary weft yarn, a plurality of bonding devices arranged next to one another for forming stitch side yarn groups for net stitch sides aligned in a travel direction of the fabric, at least one function yarn feeding means for supplying a function yarn for forming net stitch sides extending transversely of the travel direction, wherein the function yarn extends from a first longitudinal side of the fabric to a second longitudinal side of the fabric, each bonding device comprising at least one function yarn laying system for bridging a distance between the adjacently located bonding devices and for temporarily setting and laying the function yarn, the function yarn laying system comprising setting points and at least one controllable function yarn reserve forming system for acting on the function yarn between two adjacently located setting points, wherein the function yarn reserve forming system comprises elements for forming function yarn reserves.

2. The device according to claim 1, comprising a cutting and setting device each arranged at both sides of the function yarn laying system.

3. The device according to claim 1, comprising means for varying a distance between the bonding devices and the function yarn laying system including the function yarn reserve forming system.

4. The device according to claim 1, wherein the function yarn laying system comprises means for carrying out a variable lift toward the bonding devices.

5. The device according to claim 1, when the function yarn reserve forming system comprises a drive correlated to a variation control, a patterning control and control of the devices.

* * * * *